US006079388A

United States Patent [19]

Nicol

[11] Patent Number: 6,079,388

[45] Date of Patent: Jun. 27, 2000

[54] FUEL INJECTION SYSTEM

[75] Inventor: Stuart-William Nicol, Stuttgart, Germany

[73] Assignee: Robert Bosch GmbH, Stuttgart, Germany

[21] Appl. No.: 09/202,582

[22] PCT Filed: Feb. 17, 1998

[86] PCT No.: PCT/DE98/00452

§ 371 Date: Dec. 17, 1998

§ 102(e) Date: Dec. 17, 1998

[87] PCT Pub. No.: WO98/49442

PCT Pub. Date: Nov. 5, 1998

[30] Foreign Application Priority Data

Apr. 25, 1997 [DE] Germany ..... 197 17 493

[51] Int. Cl.[7] ..... F02B 3/10

[52] U.S. Cl. ..... 123/299; 123/506

[58] Field of Search ..... 123/299, 506, 123/508

[56] References Cited

U.S. PATENT DOCUMENTS

| | | | |
|---|---|---|---|
| 4,745,898 | 5/1988 | Egler et al. | 123/506 |
| 4,782,803 | 11/1988 | Kikuchi | 123/506 |
| 4,838,232 | 6/1989 | Wich | 123/506 |
| 5,070,836 | 12/1991 | Wahl et al. | 123/506 |
| 5,325,837 | 7/1994 | Laufer | 123/506 |
| 5,443,047 | 8/1995 | Ishiwata et al. | 123/506 |
| 5,803,049 | 9/1998 | Harcombe | 123/506 |

*Primary Examiner*—Erick Solis

*Attorney, Agent, or Firm*—Ronald E. Greigg; Edwin E. Greigg

[57] ABSTRACT

A fuel injection system with a fuel injection pump whose high-pressure delivery is determined by an electrically controlled valve that controls a discharge conduit. The phase of the high-pressure delivery is determined by the closing of the control valve. In order to carry out an injection that is divided into a pre-injection and a main injection, and in order to simplify the triggering of the electrically controlled valve, the cam driving the pump piston is formed so that the cam presents a region (P) in which the injection between a pre-injection and a main injection is interrupted. The pump piston remains in the position it has reached for pre-injection, moves backward, or continues to move slowly. The valve is controlled so that at a low speed, the pump work chamber is closed when the pump piston is disposed before the beginning of the cam region (V) preceding the region (P) and is open when the pump piston is still disposed in the cam region (V) and is closed again at the beginning of the cam region (H) that follows the region (P). The valve is subsequently opened again in order to end the injection, while at a high speed, the first closing of the valve per feed stroke occurs in the region (P), without a preceding pre-injection.

2 Claims, 2 Drawing Sheets

FUEL INJECTION SYSTEM

PRIOR ART

The invention is based on a fuel injection system. In a system of this kind, which has been disclosed by DE-A-36 44 257, a distributor injection pump is provided as a fuel injection. A pump piston that is driven to reciprocate and rotate at the same time, which with its rotating motion and its pump stroke, respectively supplies one of a number of injection lines. Each injection lines lead to a fuel injection valve, to supply fuel that has been brought to injection pressure. For the division of the injection into a pre-injection and a main injection, the electrically controlled solenoid valve, is opened for a short time in order to thus discharge the pump work chamber and to temporarily decrease the fuel pressure generated. This means that a very rapidly switching solenoid valve is needed, which requires a considerable expenditure in the electrical control and construction of the valve. In this connection, it is particularly disadvantageous that the interruption of the injection must occur in a time-controlled manner by means of a solenoid valve. As a result, with increasing speed, an ever greater portion of the available cam stroke is used for interrupting the injection. In comparison to the possibilities of an in-line injection pump, in which a cam respectively drives only one pump piston, with a distributor injection pump, a significantly smaller stroke is available for each injection event because the cam stroke available is limited due to the limited length of the cam track. A time-controlled interruption of the injection by means of intermediate discharging of the pump work chamber by means of a solenoid valve therefore entails a significant limitation of the output produced by the fuel injection pump. Furthermore, a special pressure control valve is provided in the connection between the pump work chamber and the injection valve. This pressure control valve opens in the feed direction with the high-pressure fuel delivery to the fuel injection nozzle and closes at the end of injection. The valve is suitable for decreasing pressure waves between the pressure control valve and the fuel injection valve and for maintaining a desired constant standing pressure in this region during the injection pauses. In a divided fuel injection with one pre-injection and one main injection per work cycle of the respective cylinder of the engine to be supplied, it is advantageous to provide for a constant standing pressure in the injection pauses.

ADVANTAGES OF THE INVENTION

The embodiment according to the invention produces a reliable interruption of the injection between the pre-injection and main injection with low requirements as to the speed of a time-controlled valve. At the same time, none of or only a very small portion of the available cam stroke is used during the interruption of the injection between the pre-injection and the main injection. The interruption of the injection, which is supported structurally by way of the cam form, achieves the fact that even at a higher speed, a reliable interruption of the injection between the pre-injection and the main injection can be maintained without a loss in a cam stroke that can be supplied for the high-pressure delivery. The speed independent influence of the switching time is compensated for by means of the second partial region of the cam so that in addition, no excessive requirements have to be placed on the speed of the electrically controlled valve.

BRIEF DESCRIPTION OF THE DRAWINGS

An exemplary embodiment of the invention is represented in the drawings and will be explained in more detail in the description below.

DETAILED DESCRIPTION

Figure 1:
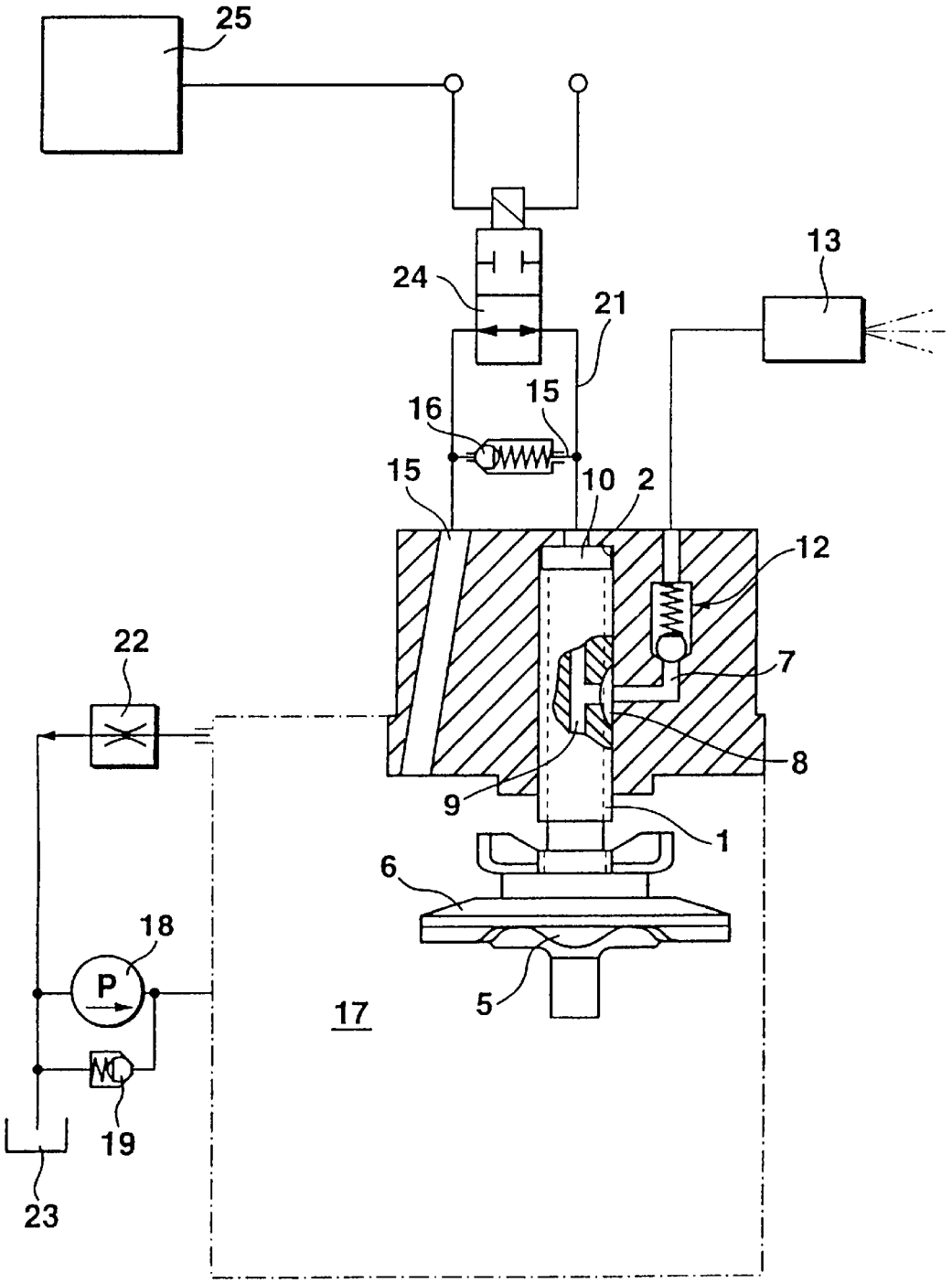
FIG. 1 is a schematic representation of a fuel injection pump, which is controlled by a solenoid valve.

In the exemplary embodiment described below, the embodiment according to the invention is realized by means of a distributor injection pump, as schematically represented in FIG. 1. That instance concerns a distributor injection pump of the axial piston type, even though the subject of the invention can also be used with other fuel injection pumps, e.g. distributor injection pumps of the radial piston pump type or single pumps with only one pump piston for supplying a single cylinder of an internal combustion engine, or in-line pumps. In a particularly advantageous manner, however, the invention can be realized with a distributor injection pump because in this instance, the available cam stroke, due to the limited length of the cam track, is smaller than with an in-line injection pump, for example. With the distributor injection pump of the type shown in FIG. 1, a pump piston 1 is provided, which is disposed so that it can slide and rotate in a cylinder bore 2 and encloses a pump work chamber 10 there on its end face. The pump piston is coupled, e.g. by way of a spring that is not shown in detail, to a cam disk 6 that has axially downward pointing cams 5 that are embodied according to the invention. The cam disk is driven to rotate in a known manner by a drive shaft, not shown in detail, in particular synchronously to the speed of the engine supplied by the injection pump, wherein the cam disk, under the influence of the spring, travels on a known, axially fixed roller ring and as a result, sets the rotating pumping and distributing piston into a reciprocating, feeding, and aspirating motion. The chronological or rotation angle-dependent travel of the rollers on the cam edge thus determines the stroke position of the pump piston. With its rotating motion in association with a pump feed stroke in which fuel is displaced at high pressure from the pump work chamber 10, the pump piston comes into communication with one of a number of injection lines 7 by way of a distributor groove 8 in the jacket face of the pumping and distributing piston. The distributor groove is continuously connected to the pump work chamber by way of a longitudinal conduit 9. The injection line leads by way of a pressure control valve 12 to a fuel injection valve 13, which is associated with the respective cylinder of an internal combustion engine.

The supply of the pump work chamber 10 with fuel is carried out by way of an intake line 15, which is supplied by an intake chamber 17, which is essentially depicted with only dashed lines, and is enclosed within the housing of the fuel injection pump. The intake chamber receives fuel from a fuel delivery pump 18, which is driven synchronously to the fuel injection pump, e.g. by the drive shaft, and consequently supplies fuel into the intake chamber in speed-dependent quantities. The pressure in the intake chamber is usually controlled in a speed-dependent manner with the aid of an additional pressure control valve 19 when additional functions of the fuel injection pump are intended to be controlled with the aid of this pressure. Fuel flows continuously back to the reservoir 23 by way of an overflow throttle 22 so that the cooling of the injection pump or the de-gassing of the intake chamber is provided for in this manner. The intake line 15 leads into the pump work chamber by way of a check valve 16, wherein the check valve opens in the direction of the pump work chamber. Parallel to this check valve, an electrically controlled valve 24 is provided, which controls a bypass line 21 to the pressure control valve 16, and with whose aid a connection is produced between the pump work chamber 10 and the intake chamber 17 when the valve is opened and the pump work chamber 10 is closed off when the valve is closed. The electrically controlled valve 24, which is symbolized as a solenoid valve, is controlled in an intrinsically known manner by a control device 25 in accordance with operation parameters. With a sufficiently great flow cross section of the valve 24, however, the check valve 16 can also be eliminated. In this instance, the pump work chamber is filled exclusively by way of the electrically controlled valve during the intake stroke.

The onset of the high-pressure delivery of the pump piston is controlled with the aid of this electrically controlled valve. Finally, the injection onset can also be controlled with the valve. In addition to this possibility, the injection onset can be adjusted by means of a separate injection onset adjusting device, which in a known manner has a cam drive part, which can be rotated in relation to the pump piston that traces the shape of the cam. When the valve closes, a pressure required for an injection event builds up in the pump work chamber 10 due to the feed motion of the pump piston. The fuel thus brought to injection pressure is supplied to one of the injection lines 7 by way of the longitudinal conduit 9 and the distributor groove 8. With the reopening of the electrically controlled valve, the high-pressure delivery is interrupted. The closure duration of the valve determines the injection quantity and as mentioned above, the injection time can also possibly be controlled with this valve.

Figure 2:
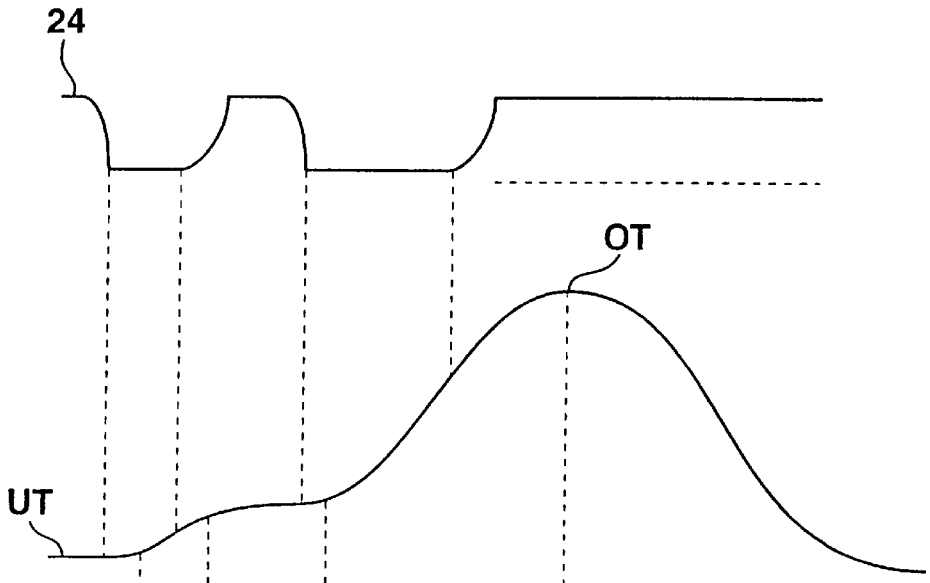
FIG. 2 shows a course of the cam track according to the invention, in the form of a cam lifting curve, over the rotation angle, with a first control sequence of the valve at a low speed of the engine.
Figure 3:
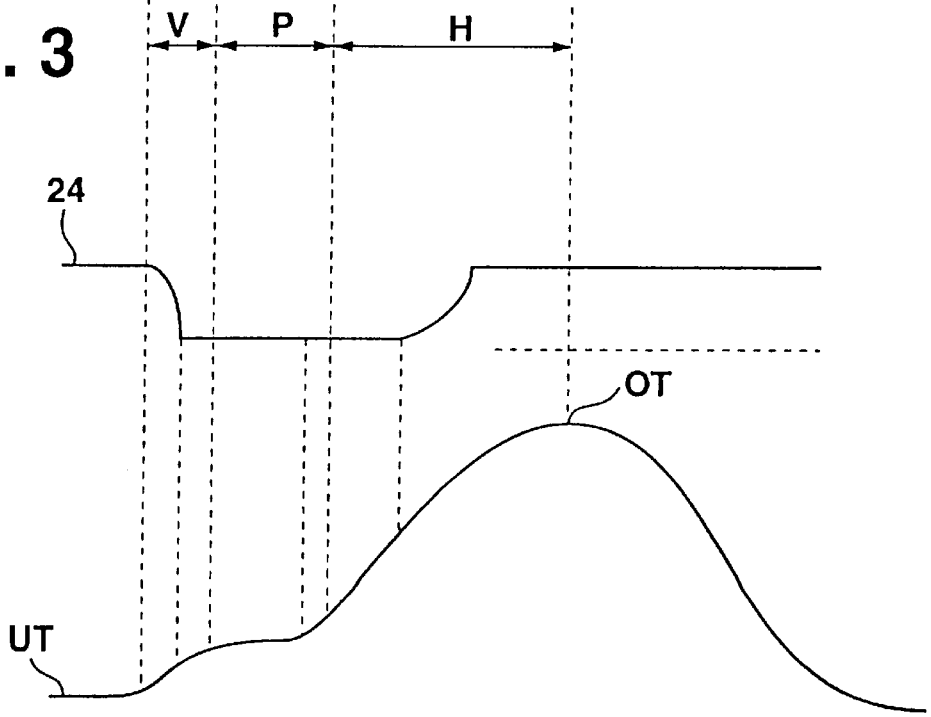
FIG. 3 shows a course of the cam track according to the invention over the rotation angle, with a second control sequence of the valve at a high speed of the engine.

According to the invention, the high-pressure delivery sides of the cam edges of the cams 5 are embodied so that as shown in FIG. 2 or 3, they generate a stroke course of the pump piston over time. The time is divided into a first region V which beginning with the feed stroke of the piston, ends after a small feed stroke, into a second region P in which the piston is then not moved at all or is only moved so slightly in the feed direction. In this region the piston is not effective for a high-pressure delivery and an injection pause is produced, and finally into a third region H in which the cam edge ascends again and moves the pump piston farther for the purpose of further delivery of the main injection quantity. In the region P, the cam can follow a horizontal, slightly ascending, or slightly descending course. The pre-injection is furthermore controlled by the electrically controlled valve so that it is closed when the rollers come into the second region P.

For an operation at a low speed, it can be inferred from the graph in FIG. 2 that the electrically controlled valve, e.g. a solenoid valve or also a valve actuated by a piezoelectric element, is closed to control the onset of the pre-injection quantity delivery in the bottom dead center, i.e. before the ascent of the cam curve out from a base circle, and is opened again in the cam region V before the cam region P is reached. After an injection pause in the region P, then a re-closing of the valve 24 follows, with the beginning of the high-pressure delivery for the main injection in the adjoining cam edge part H, where after this, through the opening of the valve 24, the high-pressure delivery is in turn interrupted and the main injection is ended. At the point of the re-closing, the requirements as to exactness of the control point are lower than with another control of an injection onset.

For the operation at a high speed, a division into a pre-injection and a main injection is not so absolutely necessary since in this instance, due to the combustion events that occur in an essentially chronologically constant manner, a shifting of the combustion in the rotation direction occurs after the top dead center of the engine piston and in this instance, ignition delays with injected fuel quantities no longer make themselves so disadvantageously apparent in the generation of noise. For this instance, which is shown in FIG. 3, the valve 24 is controlled so that it is only closed in the region of the cam edge part P so that it is reliably closed if the fuel delivery for the now sole main injection occurs in the region of the cam edge part H following the region P. The end of the injection is in turn controlled by the opening of the valve, which then as a rule occurs before the top dead center of the cam of the injection pump.

This control has the advantage that at high speeds, the pump work chamber of the injection pump can be adequately filled with fuel since in comparison to the control at a low speed, the filling phase is now extended and the piston movement in the filling direction, i.e. during the intake stroke, only has to travel into the stroke region in which the second region P is disposed. Due to the high-pressure delivery that occurs only starting at the region P, the required filling quantity of the pump work chamber is reduced. The electrically controlled valve thus closes only in the region P of the cam edge so that the intake stroke can be fully exploited for the aspiration of fuel by way of the sloping cam edge V. The inflow filling effect is still active in the beginning part of the cam edge before the region P as long as the valve is not yet closed.

In individual cases, it is possible to modify the cam shape for the purpose of an intentional divided injection and in support of the control work of the valve. In lieu of producing a returning stroke motion of the piston, this can also merely remain in its position or be moved only slightly farther so that its movement is not sufficient to permit an injection of any consequence so that even without the influence of the valve, an effective injection pause of a structurally predetermined length can occur, which reduces the fuel delivery into the combustion chamber of the internal s combustion engine so that the pressure increase in the combustion chamber becomes smaller and a low-noise combustion can be achieved.

The foregoing relates to a preferred exemplary embodiment of the invention, it being understood that other variants and embodiments thereof are possible within the spirit and scope of the invention, the latter being defined by the appended claims.

What is claimed is:

1. A fuel injection system comprising a fuel injection pump, a pump piston, said pump piston is driven by a cam drive provided with at least one cam and defines a pump work chamber (10) which is used to supply at least one fuel injection valve (13) with fuel injection quantities brought to injection pressure, an electrically controlled valve (24) for connecting the pump work chamber (10) of the fuel injection pump to or closed off from a discharge chamber (17) in order to control the injection, and with interruption of the injection between one pre-injection and one main injection per injection event, the at least one cam is embodied so that on a cam edge side that moves the pump piston to a feed stroke, said at least one cam has a first partial region (V) in which the pump piston executes a feed stroke to carry out a pre-injection, said at least one cam has a second partial region (P) in which after an ending of the pre-injection, the piston (1) essentially remains in a position the piston reaches at the ending of the pre-injection stroke and then, in order to execute the feed stroke for the main injection, said at least one cam has a third partial region (H), wherein the electrically controlled valve (24) is triggered so that at a low speed, the control valve is closed before the beginning of the first partial region (V) and in the first partial region (V), the valve is opened to end the pre-injection, and then, in order to execute the main injection, at a beginning of a third partial region, the valve is closed again and in this third partial region of the cam, the valve is opened again before the top dead center of the cam is reached, and that at a high speed, in order to initiate the main injection without a preceding pre-injection, the valve is closed within the second partial region (P) and is opened again within the third partial region in order to end the main injection before the top dead center is reached.

2. A method comprising a fuel injection system having a fuel injection pump, a pump piston which is driven by a cam drive provided with at least one cam and which defines a pump work chamber (10) which is used to supply at least one fuel injection valve (13) with fuel injection quantities brought to injection pressure, and an electrically controlled valve (24) for connecting the pump work chamber (10) of the fuel injection pump to or closed off from a discharge chamber (17) in order to control the injection, the method comprising interrupting the injection between one pre-injection and one main injection per injection event, forming a cam so that a cam edge side with a first partial region (V) which causes the pump piston to execute a feed stroke to carry out a pre-injection, forming a second partial region (P) on the cam in which after an ending of the pre-injection, the piston (1) essentially remains in a position the piston reaches at the ending of the pre-injection stroke and then, in order to execute a feed stroke for a main injection, forming the cam with a third partial region (H), wherein the electrically controlled valve (24) is triggered so that at a low speed, the control valve is closed before the beginning of the first partial region (V) and in the first partial region (V), opening the valve to end the pre-injection, and then, in order to execute the main injection, at the beginning of the third partial region, closing the valve again and in this third partial region of the cam, opening the valve again before the top dead center of the cam is reached, and that at a high speed, in order to initiate the main injection without a preceding pre-injection, closing the valve within the second partial region (P) and opening the valve again within the third partial region in order to end the main injection before the top dead center is reached.

* * * * *